United States Patent [19]

Ho

[11] Patent Number: 4,628,400

[45] Date of Patent: Dec. 9, 1986

[54] ELECTRONIC KEYED LOCK

[75] Inventor: Eugene Y. Ho, San Carlos, Calif.

[73] Assignee: Techne Electronics Ltd., Palo Alto, Calif.

[21] Appl. No.: 837,568

[22] Filed: Mar. 4, 1986

Related U.S. Application Data

[63] Continuation of Ser. No. 576,812, Feb. 3, 1984, abandoned.

[51] Int. Cl.[4] ..... H01H 47/28

[52] U.S. Cl. ..... 361/172

[58] Field of Search ..... 361/171, 172; 333/24 C; 307/10 AT; 235/382, 382.5; 340/825.31, 825.32, 542, 543, 345, 348, 870.37; 70/277, 278, DIG. 46, DIG. 49

[56] References Cited

U.S. PATENT DOCUMENTS

| | | | |
|---|---|---|---|
| 1,940,769 | 12/1933 | Potter | 333/24 C |
| 4,104,694 | 8/1978 | Hargrove | 361/172 |
| 4,280,119 | 7/1981 | May | 235/382 |
| 4,286,305 | 8/1981 | Pilat et al. | 361/172 |
| 4,317,157 | 2/1982 | Eckloff | 361/172 |
| 4,383,242 | 5/1983 | Sassover et al. | 361/172 X |

FOREIGN PATENT DOCUMENTS

| | | | |
|---|---|---|---|
| 2911828 | 10/1980 | Fed. Rep. of Germany | 361/172 |
| WO83/02352 | 7/1983 | PCT Int'l Appl. | 340/870.37 |

OTHER PUBLICATIONS

"In-Car Security System", Radio Electronics World (GB) vol., No. 7, 3/1982.

*Primary Examiner*—Michael L. Gellner
*Attorney, Agent, or Firm*—Flehr, Hohbach, Test, Albritton & Herbert

[57] ABSTRACT

A keyed lock in which a key transmits programmed high frequency pulses which are capacitively coupled to an electronic lock which processes and decodes the high frequency pulses and provides an unlocking signal when the programmed pulses match a preset lock program.

4 Claims, 5 Drawing Figures

AGC VOLTAGE
+18V
LM1360N
PN 2222

ELECTRONIC KEYED LOCK

This is a continuation of Ser. No. 576,812, filed Feb. 3, 1984, now abandoned.

This invention relates generally to an electronic keyed lock and more particularly to an electronic keyed lock which can be programmed to open only with a selected combination.

Semiconductor encoders and decoders are known. The encoders can be programmed with a pulse code and transmit the pulse code on command. The decoder receives the programmed pulse code and decodes the same and provides an output if the input pulse code matches the code resident in the decoder.

In many applications it would be useful to have an electronic keyed lock whereby no need for a keyhole for insertion of a key is necessary. This would prevent tampering since the lock location could be concealed. For example, automobile burglar alarms are presently armed and disarmed by the insertion of a key and mechanical operation of the associated lock. The location of the key hole can be easily found and tampering can occur. An electronic keyed lock can also be useful in automobiles for turning on the ignition, operating door locks, locking the trunk or hood; for homes and offices; for briefcases, suitcases; and in other applications where mechanical key locks or combination locks are presently used.

It is a general object of the present invention to provide an electronic keyed lock.

It is another object of the present invention to provide an electronic keyed lock programmable to operate on one of a large number of possible combinations.

It is a further object of the present invention to provide an electronic keyed lock which can be operated by electromagnetically coupling the key to the lock.

It is a further object of the present invention to provide an electronic keyed lock which operates outside the range of FCC licensing frequencies and which is immune to outside interference signals such as radio, infrared or ultrasound transmissions.

The foregoing and other objects of the invention are achieved by a keyed lock in which the key encoder transmits programmed high frequency pulses which are capacitively coupled to the lock. The electronic lock receives the pulses, processes them and applies them to a lock encoder which provides an output unlocking signal if the program pulses match its preset program.

The foregoing and other objects of the invention may be more clearly understood from the following description taken in connection with the accompanying drawings of which:

Figure 1:
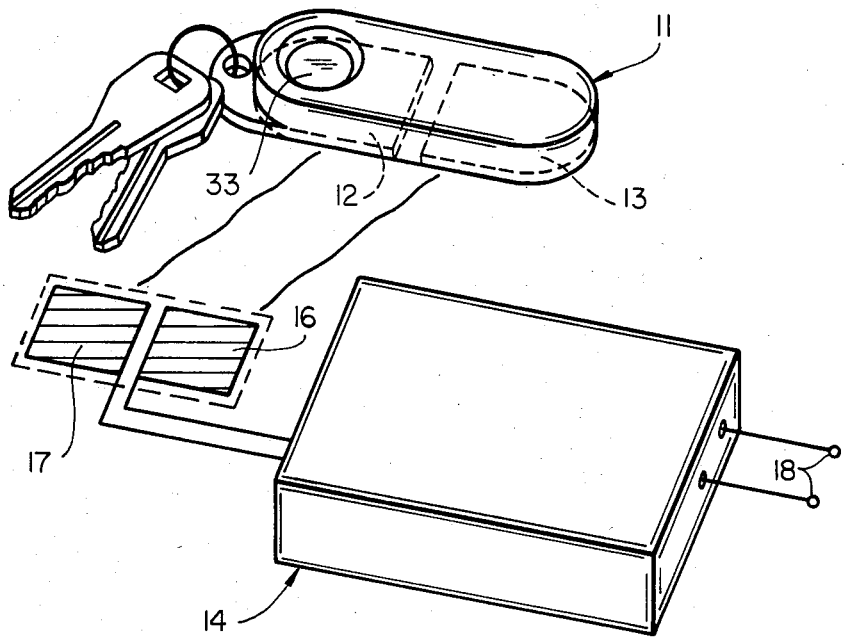
FIG. 1 is a schematic view of an electronic keyed lock combination in accordance with the present invention.

Referring to FIG. 1 the keyed lock combination is schematically shown. The keyed lock includes a "key" 11 which has encapsulated therein an electronic circuit to be presently described and which energizes a pair of capacitor plates 12 and 13 with programmed pulses of high frequency signals. The key is placed adjacent the lock 14 which includes a pair of receiving plates 16 and 17 which can be capacitively coupled to the plates 12 and 13. The pulses of high frequency signals picked up by the plates 16 and 17 are applied to the lock circuit which serves to process the pulses and match them to a preselected pulse pattern resident in the lock. An unlock signal is provided at the terminals 18 if the received pulse pattern matches the pulse resident in the lock.

Figure 4:
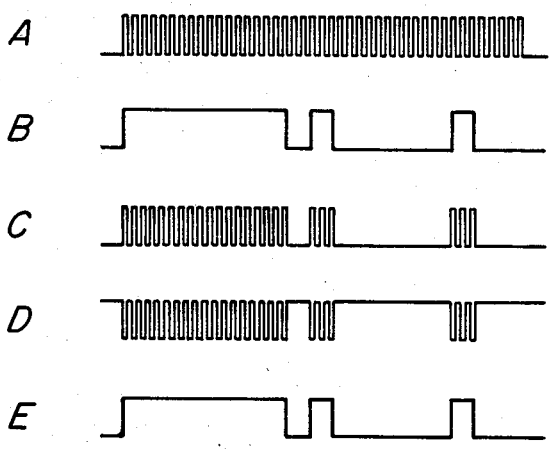
FIG. 4 is a diagram showing the waveforms at various points in the circuits of FIGS. 2 and 3.
Figure 2:
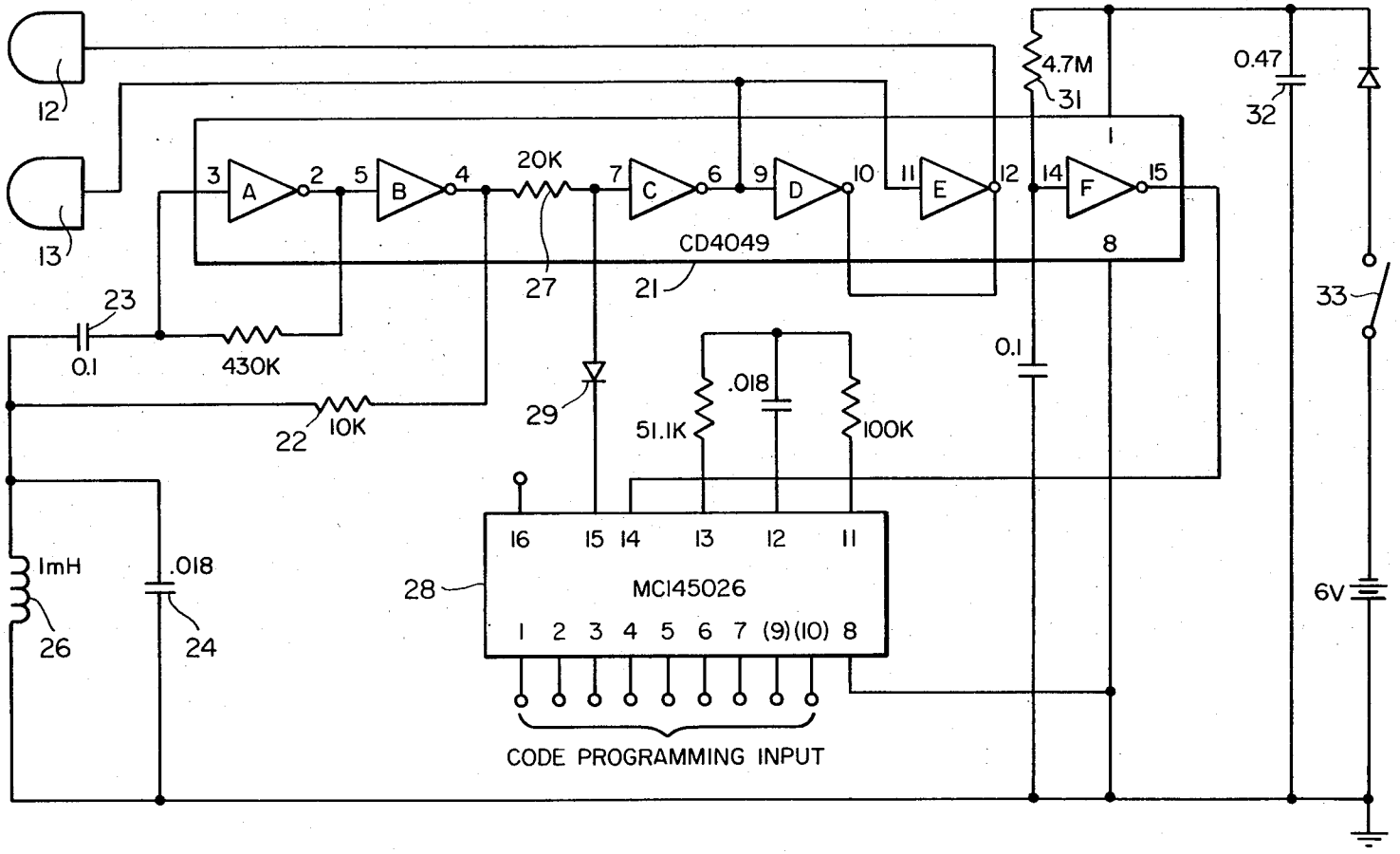
FIG. 2 is a schematic diagram of the circuit forming the electronic programmable key for the keyed lock of FIG. 1.

Referring now specifically to FIG. 2, the key includes an integrated semiconductor circuit 21 such as the circuit sold by RCA and identified as the CD 4049. The circuit consists of six inverters A–F which are connected to operate as an oscillator, out-of-phase output driver and time delay generator. Inverters A and B with input pins 3 and 5, respectively are connected as an oscillator. The feedback is through the resistor 22 connected between the output pin 4 of inverter B and the input pin 3 of inverter A via capacitor 23. This also provides the drive to parallel tuned resonant circuit consisting of the capacitor 24 and the inductor 26. The resistor 27 at pin 4 of the inverter B serves as a current limiter so that the digital signals generated by the integrated circuit 28 can turn the diode 29 on and off and in turn interrupt the carrier frequency from the output of the oscillator on pin 4 going into the output driver amplifier C. The inverters D and E are connected in parallel and produce a square wave which is out of phase with the signal output of pin 6 of the inverter C. The capacitor plates 12 and 13 are driven with the out-of-phase square wave pulses at a frequency of about 37 kHz as determined by the capacitor 24 and inductor 26 forming the parallel tuned circuit connected to the input of the inverter A. Output signal at pin 4, FIG. 4A, is interrupted by the code generator pulses, FIG. 4B, to form the mark and space sequences of pulses of energy having said high frequency signal for data transmission as illustrated in FIGS. 4C and 4D.

Operation of the circuit 28 can be more clearly understood from the manufacturer's data sheet. A simple explanation is given as follows: The circuit has a built in R-C oscillator with its frequency determined by resistors and capacitors connected to the pins 11, 12 and 13 as shown. When the transmit enable pin 14 is driven to ground potential the device will scan the input pins 1–7, 9 and 10 and transmit their state. These pins can have three possible programing states, power, ground and open. This gives the possibility of approximately 13,000 different combinations.

The resistor 31 and capacitor 32 connected to the integrated circuit 21 forms a delay circuit so that when power is applied to the circuit it will keep the pin 14 of inverter F at zero volts for about one-half second. This delay keeps the inverter output at six volts for about one-half second before it comes down to ground potential. The delay is necessary because of the design of the circuit 28. It allows the internal oscillator of the circuit 28 to have sufficient time to start when power is applied to the key via the switch 33.

Figures 3A, 3B:
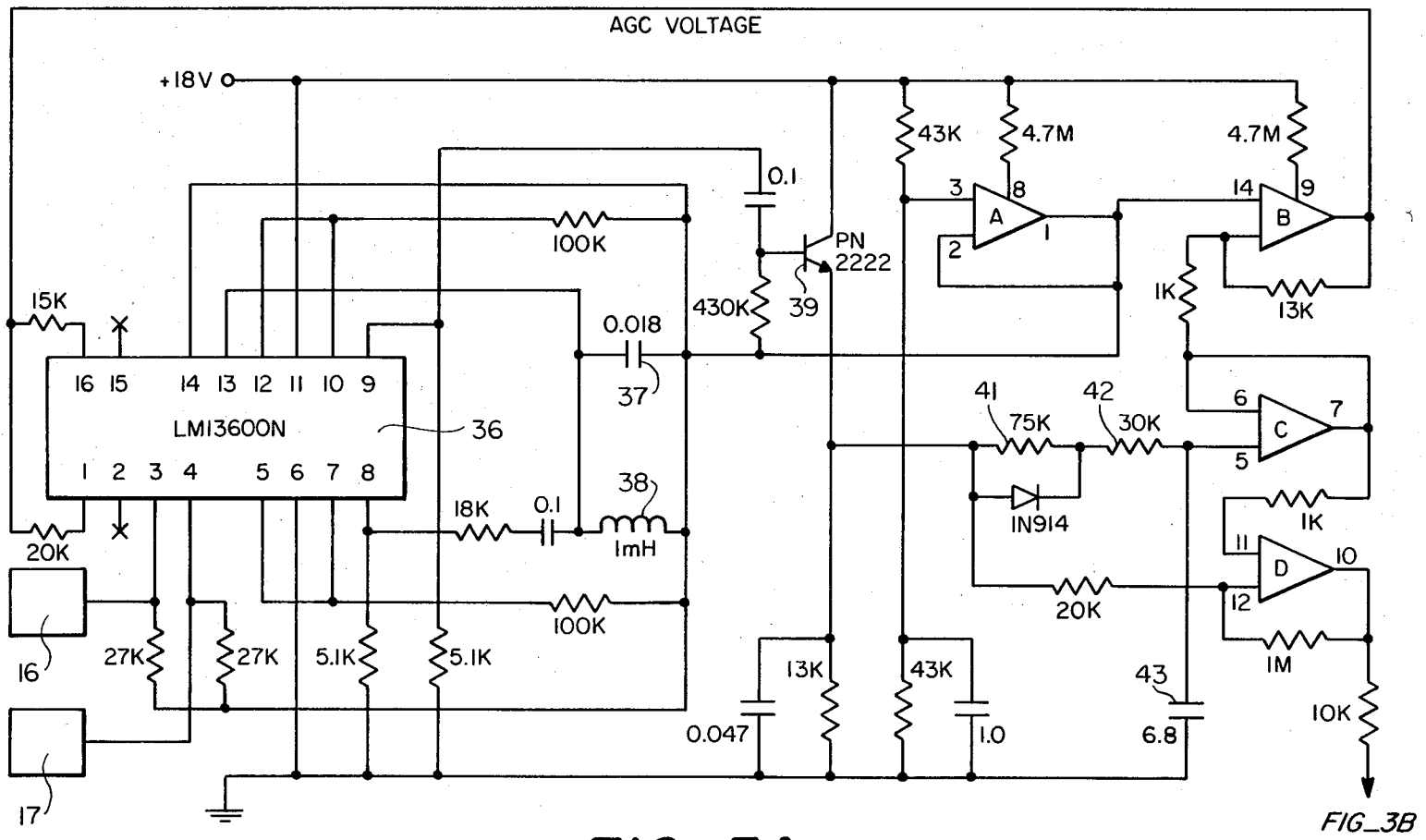
FIGS. 3A and 3B are a schematic diagram showing the programmed electronic lock of FIG. 1.
Figure 3B:
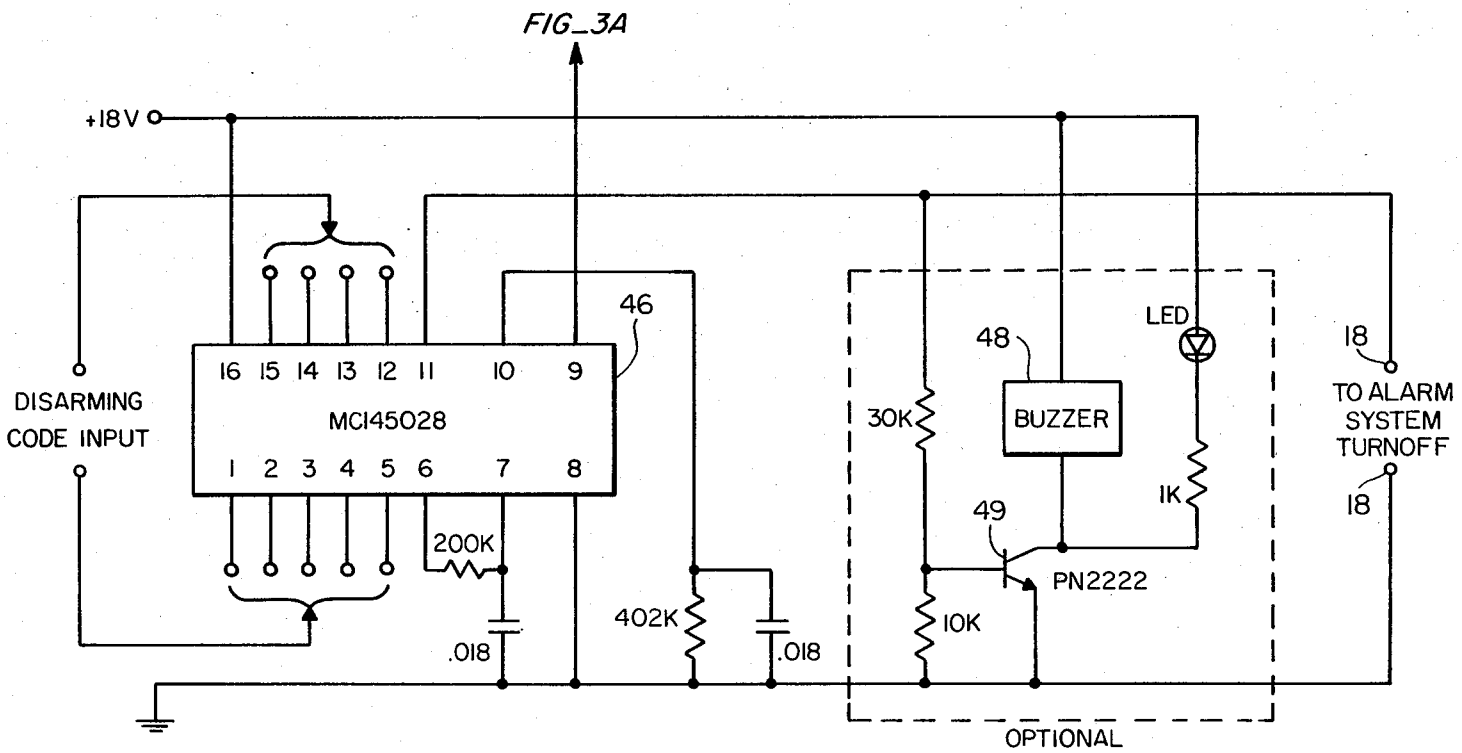

The lock or receiver, FIG. 3, is capacitively coupled to the key by means of the pads 16 and 17. The lock includes an integrated circuit 36 which operates as an amplifier with automatic gain control. The circuit includes two amplifiers. Signals are coupled from the output of the first amplifier, pin 8, to input of the second amplifier, pin 13, through a parallel tuned circuit including capacitor 37 and inductor 38 which is tuned to the same frequency as the tuned circuit in the key. This circuit acts as a band pass filter to allow signals at the selected frequency to be amplified. The transistor 39 serves as an envelope detector to provide output pulses corresponding generally to the input pulses, FIG. 4B.

The output from the envelope detector 39 is applied to a quad operational amplifier consisting of amplifiers A, B, C and D. The amplifier A is used to generate one-half of the supply voltage needed for the biasing of the circuit 36, the AGC amplifiers and associated circuits. The amplifier B acts as an AGC control voltage amplifier. It operates to maintain the detected envelope to be approximately one-half supply voltage by changing the voltage drive to the pin 16 of the input circuit 36 and varying the current flow in the pins 1 and 16. The necessity for such control is due to the fact that depending upon the closeness of the capacitor plates the detected signal amplitude will vary. The output should be maintained at substantially constant amplitude and therefore the AGC automatic gain control feature. The signal from the envelope detector is applied to unity gain voltage follower, amplifier C, which presents a high impedance for the integrating time constant of the resistors 41, 42 and capacitor 43 connected to pin 5. It also supplies a low impedance driving source at pin 7 to drive the AGC control voltage amplifier B and threshold detector D. The detector compares the envelope of the detected wave with the same wave after being fed through the integrator comprising resistors 41, 42 and capacitor 43. The threshold generator will generate voltage swings, pin 10, from power to ground in response to small voltage swings of the input.

The output square waves, FIG. 4E, correspond to the code in the encoder and are then applied to the disarming decoder 46. The decoder operation can be described as follows: sequential data bits are sent into the circuit at pin 9, the circuit will start to compare data stream with the local code previously input on pins 1–5 and 12–15. If the incoming code matches the local code twice in a row the voltage on pin 11 will go high to indicate a correct sequence of data. This voltage can then be used to disarm the alarm in an automobile or to operate a lock or associated apparatus. In addition, the output signal may be used to turn on a buzzer 48 via a circuit such as shown and including the transistor 49.

An electronic keyed lock was constructed and operated in which the integrated circuits were as follows:

Circuit 21 CD 4049 sold by RCA

Circuit 22 MC 145026 sold by Motorola

Circuit 36 LM 13600N sold by National Semiconductor

Circuit 46 MC 145028 sold by Motorola

Lock circuits A,B,C & D XR 094 sold by EXAR

Values and connections of the other components are shown in FIGS. 2 and 3. The circuit operated satisfactorily to provide an output signal when the key code matched the lock code and would not respond to other key codes.

Thus, there has been provided a key lock combination in which a key provides encoded output pulses of high frequency signal which are picked up by the lock and processed. A decoder in the lock provides an output control signal when the code transmitted by the key matches the code resident in the lock.

What is claimed:

1. An electronic keyed lock comprising a key including an oscillator operated to provide signals at a predetermined frequency outside the range of FCC licensing frequencies, means including an encoder for receiving said oscillator signals and providing programmed pulses of energy having said predetermined frequency means for applying power to said key and means for delaying the provision of programmed pulses for a predetermined time, a lock, means for coupling said programmed predetermined frequency pulses to said lock, means for receiving said programmed pulses of energy and forming output programmed pulses and a decoder pre-programmed with said pulse program for receiving said output pulses and providing an output signal when the output programmed pulses twice match the pre-programmed pulse program in said decoder.

2. An electronic keyed lock as in claim 1 in which said key is capacitively coupled to said lock.

3. An electronic keyed lock as in claim 2 in which said means for capacitively coupling the key to the lock includes a pair of conductive plates in said key and a pair of conductive plates in said lock.

4. An electronic keyed lock as in claim 3 in which said means including an encoder providing pulses of energy of opposite polarity to said pair of plates.

* * * * *